United States Patent [19]

Canfield

[11] 4,093,120

[45] June 6, 1978

[54] RAILROAD CROSSING STRUCTURE

[75] Inventor: David L. Canfield, Libertyville, Ill.

[73] Assignee: Park Rubber Company, Lake Zurich, Ill.

[21] Appl. No.: 761,703

[22] Filed: Jan. 24, 1977

[51] Int. Cl.[2] ..... E01C 9/04

[52] U.S. Cl. ..... 238/8; 404/41; 404/66

[58] Field of Search ..... 238/2, 3, 5, 6, 7, 8, 238/9; 404/32, 33, 41, 47, 69, 66; 14/16.5

[56] References Cited

U.S. PATENT DOCUMENTS

| | | | |
|---|---|---|---|
| 1,191,561 | 7/1916 | Burns | 238/8 |
| 1,411,415 | 4/1922 | Cooley | 238/8 UX |
| 1,827,823 | 10/1931 | Myers | 238/8 |
| 2,287,844 | 6/1942 | Tiberghien | 404/33 |
| 2,828,079 | 3/1958 | Rennels | 238/8 |
| 4,009,827 | 3/1977 | Tafel | 238/8 |

*Primary Examiner*—Randolph A. Reese
*Attorney, Agent, or Firm*—Dominik, Knechtel, Godula & Demeur

[57] ABSTRACT

A railroad crossing structure comprising one or more elastomeric pads which preferably have a flexible plate of a concave cross-section imbedded within them. The elastomeric pads are abutted together side-by-side and-/or end-to-end to form the crossing, and the abutting edges thereof are formed with interlocking means to provide moisture-proof seams between them. The elastomeric pads are secured in place by means of rods extended longitudinally through them, with the ends of the rods being secured to anchor means.

12 Claims, 6 Drawing Figures

RAILROAD CROSSING STRUCTURE

BACKGROUND OF THE INVENTION

This invention relates to an improved railroad crossing structure.

In recent years, considerable efforts have been made to provide an improved railroad crossing structure, one which is both safe for rail and vehicle traffic and which eliminates the foremost causes of grade crossing problems. While many railroad crossing structures have been proposed, and a number of them have provided various improvements, the majority if not all of these proposed structures have been generally unsatisfactory, for one reason or another.

For example, while most of the proposed structures have improved the safety for both rail and vehicle traffic, they have failed to satisfactorily eliminate the various grade crossing problems encountered by the railroads in installing and maintaining the crossing structures. One of the principal objections and the major problem with the presently available crossings is the fact that the railroad ties and/or the spacers normally used during installation of the crossing structures tend to deteriorate in a relatively short time, to the point where these ties and/or spacers must be replaced. Replacing the ties and/or spacers, of course, requires that the entire structure be torn up. The reason that the ties and/or spacers deteriorate is due to the fact that the crossing structures normally are secured in place by means of spikes or the like driven through the crossing structures into the ties or spacers. Many times the ties and spacers are split when the spikes are driven, or they subsequently split after vehicle or rail traffic has passed over the crossing for a period of time. Many of the spikes also simply loosen and, thus, no longer function to secure the crossing structure in place.

Another major problem lies in the deterioration of the ballast or sub-structure which subtends the ties and, hence, the rails and crossing structures, as a result of moisture which enters and/or is retained therein. Many of the proposed and/or available crossing structures lack adequate means for eliminating this moisture.

Other problems exist which the prior crossing structures fail to satisfactorily solve, thus the industry is still seeking to provide a crossing structure which not only solves most, if not all, of these various problems, but one that also is commercially feasible and is easy to install and maintain.

SUMMARY OF THE INVENTION

The railroad crossing structure of the present invention comprises a solution to the problem of providing a satisfactory railroad crossing structure. In particular, in its simplest embodiment, the crossing structure is formed with a number of elastomeric pads which are secured in place between the rails and between the rails and the roadway by means of at least a pair of rods which extend longitudinally through the elastomeric pads. The opposite ends of these rods are secured to tie down means which, in the illustrated embodiment, are anchor plates which are fixedly secured to the two ties which are disposed adjacent the opposite longitudinal ends of the elastomeric pad or pads, i.e., the rods span across the width of the crossing structure, whether the latter includes one or more elastomeric pads. When secured in this fashion, the necessity and use of the tie downs, for example, spikes, into the ties, as in the past, is eliminated, as is the possibility of splitting the ties during construction. Thus, the useful life of the ties is greatly increased.

While the above-described construction provides a substantial improvement over existing crossing structures, further improvements are provided by imbedding within the elastomeric pad a flexible plate of a generally concave cross-section. The opposite longitudinal edges of the flexible plates advantageously are formed or provided with securement means such as a hollow cylindrical channel for receiving therethrough the rods which are used to secure the elastomeric pads in place. During installation, the elastomeric pad or pads simply are placed in position, and the rods are extended through the cylindrical channels and the opposite ends thereof secured to the anchor plates, to secure the elastomeric pads in place.

The elastomeric pads preferably and advantageously are provided with generally V-shaped channels which extend longitudinally along the edges thereof that are disposed adjacent the rails, with these V-shaped channels forming a flange area for receiving therein the flange portion of the wheels of a railroad car. These V-shaped channels also form drainage areas for draining moisture such as rain and snow from the crossing structure.

The construction of the flexible plates imbedded within the elastomeric pads provide a deflecting action as vehicles drive over the crossing structure. This deflection forces the edges of the flexible plates and/or the rods towards or into the V-shaped channel or flange area of the elastomeric pads, thus functioning to break up foreign objects such as snow, ice and the like which may form or collect in this area.

While an elastomeric pad of a width proportioned to fit tightly between the rails, and having at least one and preferably two such flexible plates imbedded in it, can be used, according to a preferred embodiment of the invention, two elastomeric pads which are of a like size and are proportioned to fit tightly between the rails are used, for ease of installation. Each of these pads has a flexible plate imbedded within it, and the abutting edges thereof are provided with interlocking means such as a tongue and groove, whereby the abutting edges are tightly sealed to prevent moisture from seeping through between them. The opposite ends of the pads also are preferably provided with such interlocking means so that the adjoining edges of the pads when positioned end to end are tightly sealed in this same fashion. Accordingly, even though the crossing structure is formed of a number of the pads which are abutted and joined together, both in width and in length, the finished structure effectively constitutes a unitary surface which provides complete protection for the sub-structure and ties. The crossing structure therefore provides protection against deterioration.

Also, the surface of the crossing structure preferably is disposed slightly above the rail level, so that the bumps normally experienced by a vehicle crossing over the crossing structure is substantially, if not completely, eliminated. The surface can be formed with, for example, raised "nubs" or the like to provide greater traction for vehicles crossing over the crossing structure, thus providing a smooth and safe crossing.

The use of anchor plates provide still another advantage in that the size thereof can be increased to include the corner ends of the roadway. Accordingly, the entire structure is effectively contained in a fashion such that what is generally termed as "cornering" of the crossing and railroad is prevented.

Accordingly, it is an object of the present invention to provide an improved railroad crossing structure.

BRIEF DESCRIPTION OF THE DRAWINGS

The invention is illustrated in the accompanying drawings, wherein.

DETAILED DESCRIPTION OF THE INVENTION

Figure 1:
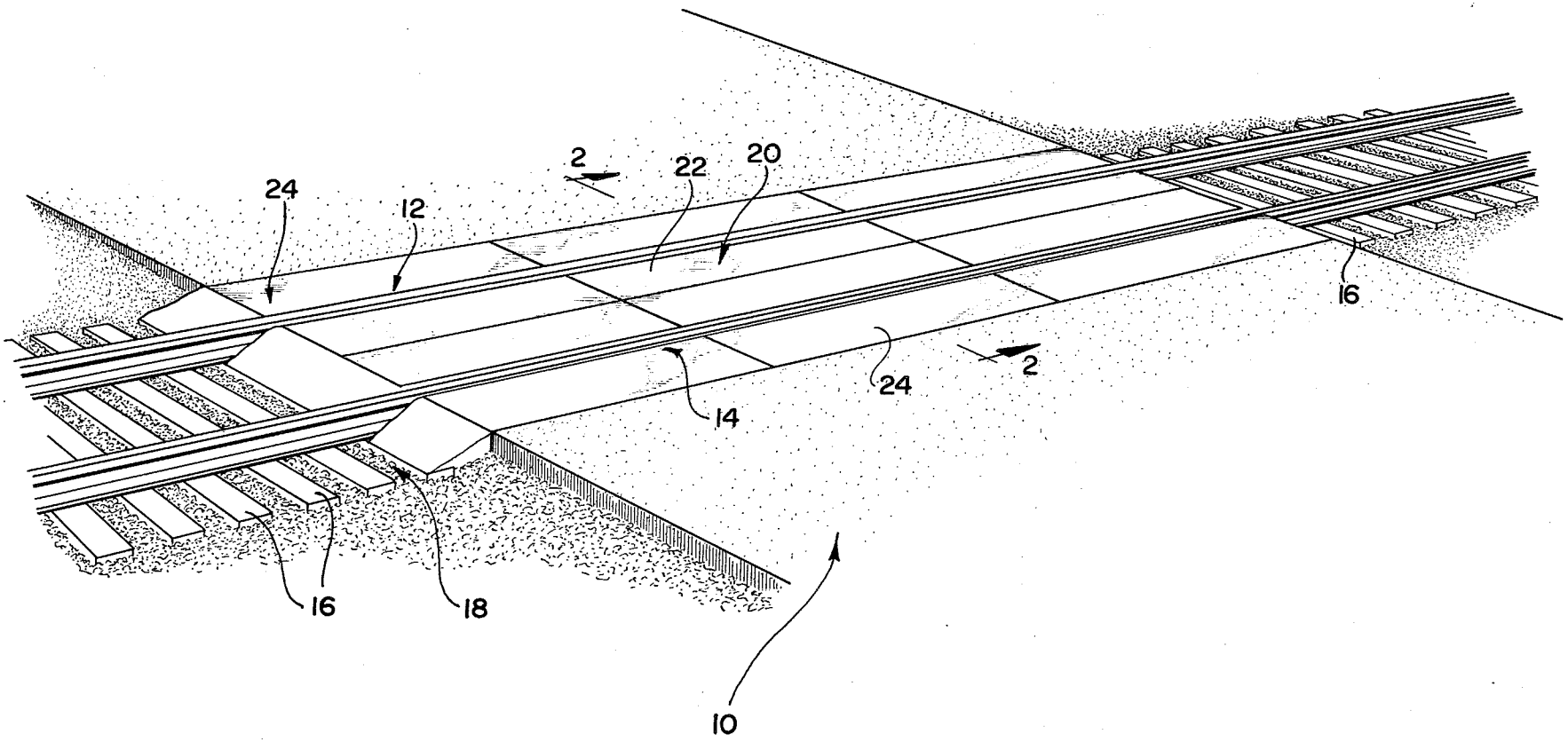
FIG. 1 is a perspective view generally illustrating a railroad crossing structure exemplary of the present invention.

Referring now to the drawings, in FIG. 1 there is generally illustrated a roadway 10 which is intersected by a railroad track including a pair of rails 12 and 14. The railroad track is of a generally standard construction, with the rails 12 and 14 being supported upon and secured to a number of ties 16 which are, in turn, supported by means of the ballast or sub-structure 18. A railroad crossing structure exemplary of a preferred embodiment of the invention is illustrated and provides a means whereby vehicle traffic on the roadway can safely travel the roadway 10 and cross the railroad track.

The railroad crossing structure 20, as can be best seen in FIGS. 1–4, as illustrated, is formed of three pairs of elastomeric pads 22 which are disposed between the rails 12 and 14 and a corresponding number of elastomeric pads 24 which are disposed between the roadway and the respective ones of the rails 12 and 14, all as more fully described below.

Figure 5:
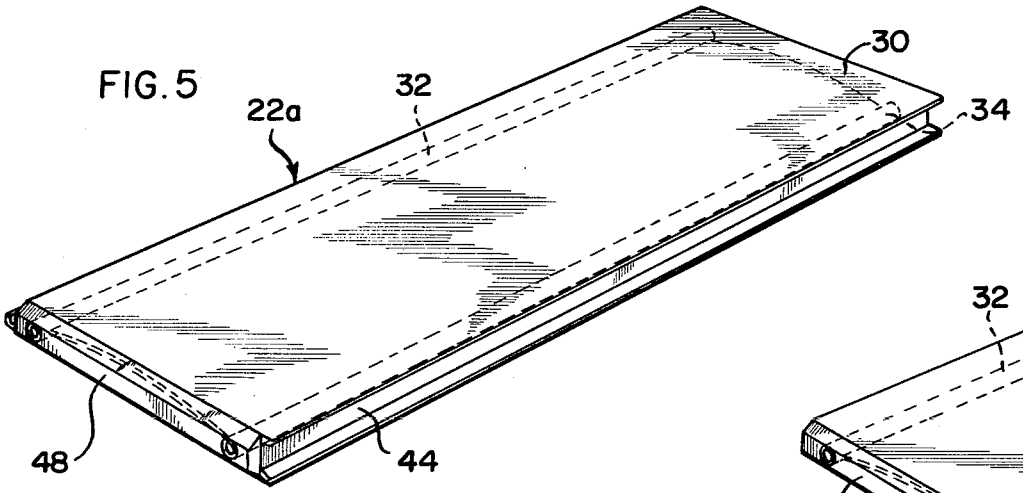
FIGS. 5 and 6 are perspective views of two elastomeric pads exemplary of the invention.
Figure 6:
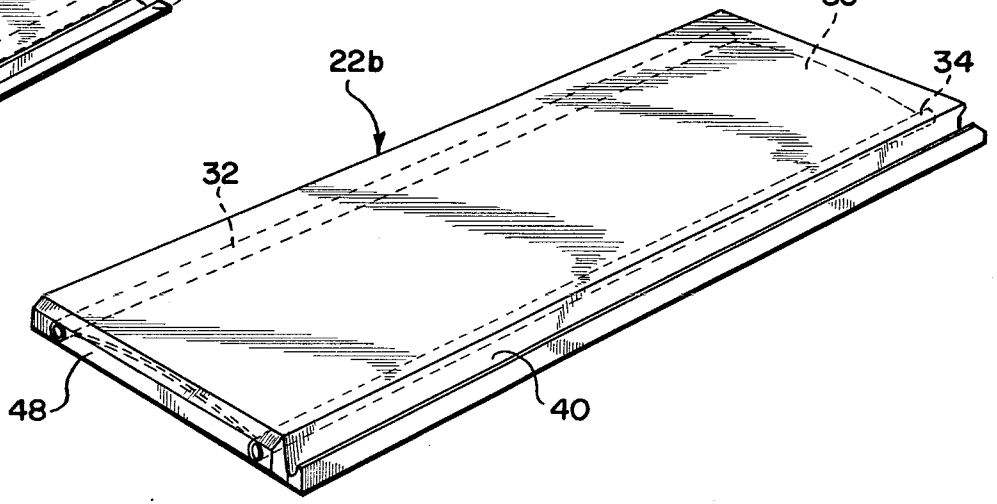

The elastomeric pads 22, as can be best seen in FIGS. 5 and 6, can be molded of rubber or other similar material and are of a generally rectangular shape. The pads 22 are formed in complimentary pairs **22*a* and 22*b* which are generally alike, however, the adjoining or abutting edges of the two pads 22*a* and 22*b* have interlocking means 44 which may be, for example, a complimentary tongue and groove arrangement, for reasons which will be apparent from the description below. Also, the opposite longitudinal edges thereof are formed with a generally V-shaped channel 40 which, as described more fully below, provides a flange area for receiving therein the flange portion of the wheels of a railroad car, as well as a drainage area for draining moisture such as rain, snow and the like from the railroad crossing structure. The opposite ends of the elastomeric pads 22*a* and 22*b* also are formed with interlocking means 48 which may be, for example, complimentary tongue and groove arrangements, which permit the ends of the elastomeric pads 22 to be joined together to provide a tight seal between the adjoining edges when the elastomeric pads are abutted together end to end, as can be best seen in FIG. 3**.

Figure 2:
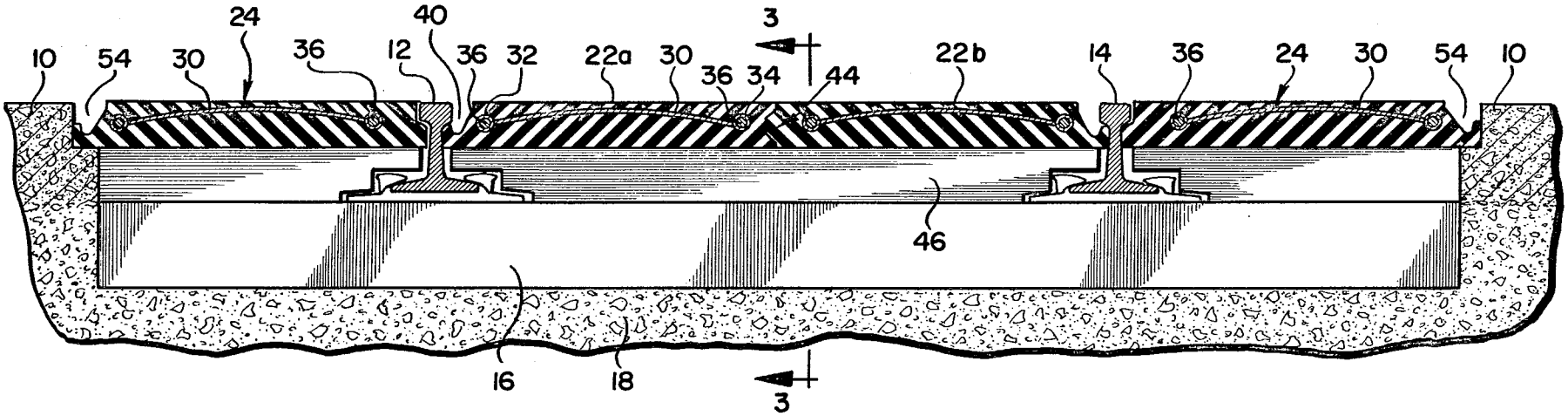
FIG. 2 is a sectional view taken generally along lines 2—2 of FIG. 1.
Figure 4:
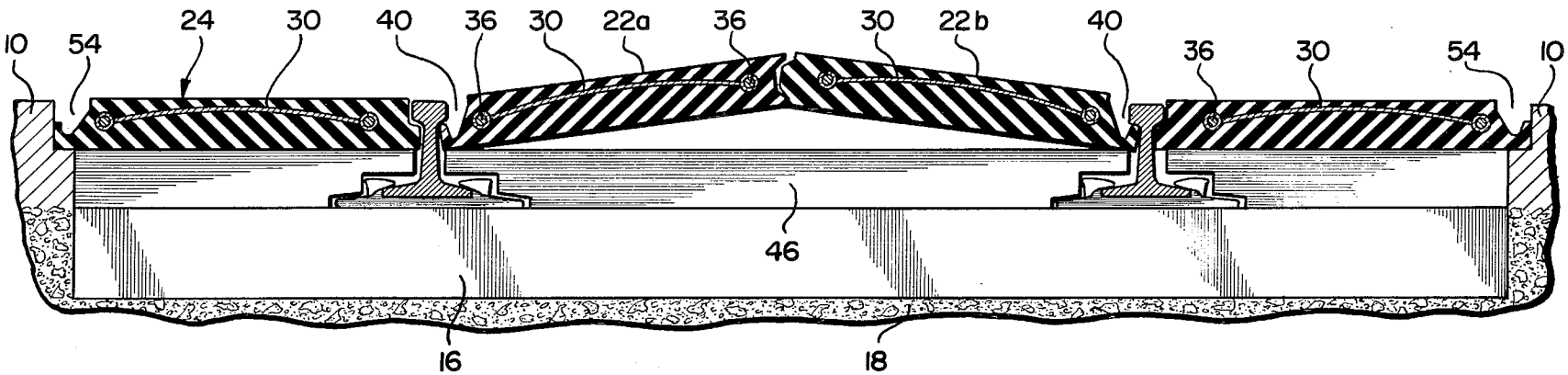
FIG. 4 is a sectional view generally like FIG. 2, illustrating the manner in which the elastomeric pads are assembled between the rails.

A flexible plate 30 which preferably and advantageously is a spring-steel plate with a slight concave cross-section is imbedded within each of the elastomeric pads 22, as can be best seen in FIGS. 2 and 4. Securement means 32 and 34 are provided along the opposite longitudinal edges of the flexible plates 30. Preferably and advantageously, these securement means 32 and 34 are hollow cylindrical channels which extend along the longitudinal length of the flexible plates 30. These hollow cylindrical channels can be formed on the edges of the flexible plates 30 by rolling the edges thereof or, alternatively, hollow pipes or the like can be secured thereto in an appropriate fashion, as by welding them to the flexible plates.

Figure 3:
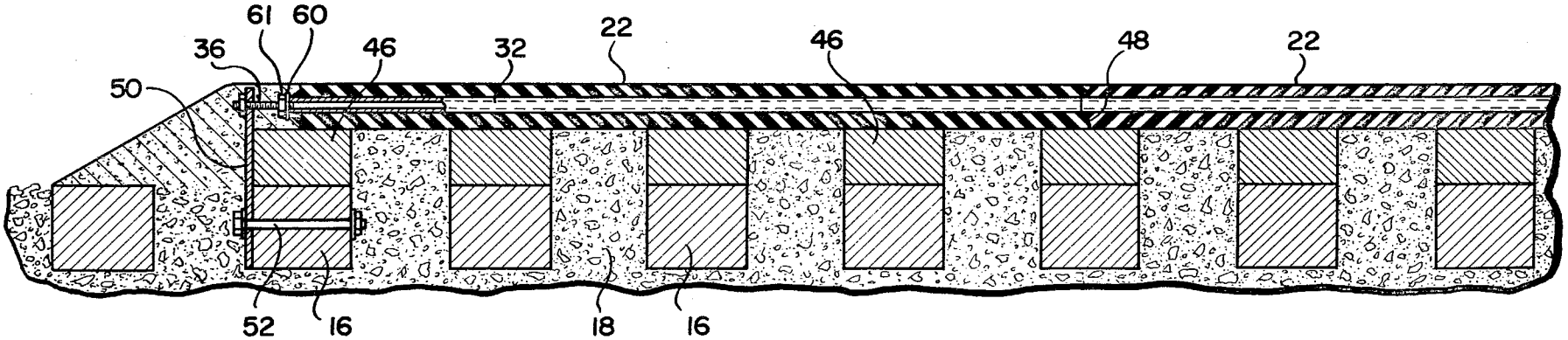
FIG. 3 is a sectional view taken generally along lines 3—3 of FIG. 2.

As can be best seen in FIG. 3, the elastomeric pads 22 are secured in place by means of rods 36 which are extended through the hollow cylindrical channels 32 and 34. The opposite ends of the rods 36 are secured to anchor means which, in the illustrated embodiment, are simply anchor plates 50 which are fixedly secured to the two ties which are disposed adjacent the opposite longitudinal ends of the elastomeric pad or pads 22 forming the crossing. The anchor plates 50 may be secured to the ties by means of threaded anchor bolts and nuts 52 extended through holes formed in the ties 16 and the anchor plates 50, as can be best seen in FIG. 3. The ends of the rods 36 likewise are extended through holes formed in the anchor plate 50 and are threaded to receive a nut 51 for securing the rods 36 to the anchor plate 50.

The elastomeric pads 24 are generally like the elastomeric pads 22, however, the one longitudinal edge thereof which abuts against the rail 12 or 14 is formed with a cross-sectional profile which substantially corresponds to the cross-sectional profile of the rail 12 or 14 so that these edges of the elastomeric pads 24 when installed, abut tightly against the rail 12 and 14 to effectively provide a water-tight seal between the edge of the elastomeric pad and the rail. The opposite longitudinal edges of the elastomeric pads 24 are provided with generally V-shaped channels 54 which are generally like the channels 40 in the elastomeric pads 22, however, in this case, these channels 54 function merely as drainage channels.

In installing the railroad crossing structure 20, the elastomeric pads **22*a* and 22*b* are positioned between the rails 12 and 14, as generally illustrated in FIG. 4, and then the two elastomeric pads 22*a* and 22*b* are forcibly urged downwardly between the two rails 12 and 14. The elastomeric pads 22*a* and 22*b* are generally of the same width and are proportioned to fit tightly between the two rails 12 and 14. Accordingly, when installed, the edges of the elastomeric pads 22*a* and 22*b* abut tightly against the perspective rails 12 and 14 and the interlocking means 44 are tightly engaged so that the edges between the elastomeric pads 22 and the edges between the elastomeric pads 22 and the respective rails 12 and 14** are tightly sealed to prevent moisture from passing through these edges.

The upper surface of the elastomeric pads 22 preferably and advantageously are disposed slightly above the height of the rail 12 and 14 and, for this reason, spacers 46 can be secured atop the ties 16 to support the elastomeric pads 22, to properly position the elastomeric pads 22.

After the elastomeric pads 22 have been installed between the rails 12 and 14, in the manner described above, with a number of the elastomeric pads 22 placed end to end, as illustrated in FIG. 1, being dependent upon the width of the roadway 10, the rods 36 are extended through the hollow cylindrical channels 32 and 34 and the ends thereof are secured to the anchor plates 50 which have been previously secured to the ties 16, as described above. The elastomeric pads 22 can be further secured in place to prevent longitudinal displacement thereof to maintain the moisture-proof seal between the interlocking means 48 by means of a plate 60 placed across the terminal ends of the outer most elastomeric pads 22 and a threaded nut 61 which is threaded onto the end of the rods 36 to abut against the plate 60. When the elastomeric pads are assembled in place, as described above, the respective ones of the nuts 61 at the opposite ends of the rod 36 can be threaded against the plates 60 to forcibly urge the elastomeric pads tightly together to effect the water-tight seal at the interlocking means 48 and to prevent them from spreading during use.

The elastomeric pads 24 are installed between the edge of the roadway 10 and the respective ones of the rails 12 and 14, in generally the same fashion. In this respect, the edge of the roadway 10 can be formed or cut away to provide a shoulder 64 for supporting the longitudinal edge of the elastomeric pads 24, as can be best seen in FIGS. 2 and 4. The elastomeric pads 24 also are proportioned to tightly abut against the edge of the roadway 10 and the respective ones of the rails 12 and 14 so that a substantially moisture-proof seal is provided between the elastomeric pads 24 and the roadway 10 and the rails 12 and 14. The elastomeric pads 24 then are secured in place and against longitudinal displacement in the same fashion as described above with respect to the elastomeric pads 22.

As indicated above, by forming the railroad crossing structure with a number of elastomeric pads which are secured in place between the rails and between the rails and the roadway by means of rods which are extended longitudinally through the elastomeric pads, the necessity and use of tie downs, such as, for example, spikes, into the ties, as in the past, is eliminated. Accordingly, while in the specifically illustrated and described embodiment, the rods are extended through hollow cylindrical channels 32 and 34 provided on the longitudinal edges of the flexible plates 30 imbedded within the elastomeric pads, it is obvious that this advantageous feature of the railroad crossing structure of the present invention can be provided simply by forming the elastomeric pads in a fashion such that the rods 36 can be extended through them and the elastomeric pads secured in place, as described.

While such a construction provides a substantial improvement over existing crossing structures, further improvements are provided by imbedding within the elastomeric pads a flexible plate 30, as described. The flexible plates 30 being of spring-steel and of a concave cross-section have a deflecting action as vehicles drive over the crossing structure, and this deflection action forces the edges of the flexible plates and/or the rods towards or into the V-shaped channel or flange area of the elastomeric pads. This deflecting action of the flexible plates thus not only acts as a shock absorber to provide a vehicle's smoother transition over the crossing, but also functions to break up foreign objects such as snow, ice and the like, which may form or collect in the V-shaped channel or flange area 40.

While in the illustrated embodiment, two elastomeric pads 22*a* and 22*b* are illustrated disposed between the rails 12 and 14, it would be apparent that many, if not all, of the advantages thereof can be provided with a single elastomeric pad of a width proportioned to fit tightly between the rails 12 and 14 having at least one, and preferably two, flexible plates 30 imbedded in it. In other words, a single elastomeric pad of the same general construction as the two elastomeric pads 22*a* and 22*b* when abutted together could be utilized. By using two flexible plates 30, with the latter being imbedded within the single elastomeric pad generally in the same fashion as the flexible plates imbedded within the elastomeric pads 22*a* and 22*b*, the elastomeric pad would have sufficient resiliency to be bowed, as generally illustrated in FIG. 4, to install it between the two rails 12 and 14. In either case, the adjoining edges of the elastomeric pads when positioned end to end are tightly sealed by means of the interlocking means thereon, so that the finished structure effectively constitutes a unitary surface which provides complete protection for the substructure and ties.

During the installation of the railroad crossing structure 20, as indicated above, the anchor plates used to secure the elastomeric pads 24 in position can be increased in width to encompass or overlap the corner edges of the roadway 10. By securing the anchor plates 50 to the roadway 10, the entire structure is effectively contained in a fashion such that what is generally termed as "cornering" of the crossing and roadway is prevented.

Accordingly, from the above description, it can be seen that an improved railroad crossing structure is provided. In particular, the manner in which the elastomeric pads are secured in position by means of the rods extended longitudinally through them, with the ends of the rods secured by means of the tie down or anchor plates, eliminates many of the problems associated with existing crossing structures. Also, the provision of the flexible plates within the elastomeric pads, the plates being imbedded therein during the molding of the pads, provides a shock absorbing effect for the pads to cushion vehicles crossing the pads to thereby provide a smoother and safer crossing. The flexible pads also, through the deflection action, function to break up foreign objects such as snow, ice and the like which may lodge in the V-shaped channels which function as drainage channels to drain moisture from the crossing structure. The interlocking means on the pads prevent moisture from draining through the crossing structure, thus deterioration of the sub-structure is substantially eliminated. These are only several of the various improvements; other not specifically mentioned will be apparent to those skilled in the art.

What is claimed is:

1. A railroad crossing structure for use with a highway railroad crossing having a pair of spaced, substantially parallel rails, a plurality of elongated ties subtending and supporting said rails and being disposed transversely thereof, and means for securing said rails to said ties, said railroad crossing structure comprising:

(a) an elongated elastomeric pad of a width proportioned to span the distance between said pair of spaced, substantially parallel rails, and having along at least one edge thereof a channel for receiving therein the flange portion of a wheel of a railroad car and for providing a drainage channel for water and the like;

(b) a flexible plate of a generally concave cross-section imbedded within said elastomeric pad, said flexible plate having a deflecting action as vehicles drive over said railroad crossing structure which functions as a shock absorber to provide a vehicle smoother transition over said railroad crossing structure and to force the edge of said flexible plate towards said channel to break up foreign objects such as snow, ice and the like which may form or collect in said channel; and (c) tie down means for securing said elastomeric pad atop said plurality of ties, said tie down means comprising anchor means, the opposite ends of said flexible plate being coupled and secured to the respective ones of said anchor means.

2. The railroad crossing structure of claim 1, further comprising securement means affixed to the opposite sides of said flexible plate along the longitudinal edges thereof, said tie down means further comprising a pair of rod means extending longitudinally through said elastomeric pad and secured respectively to the opposite side edges of said flexible plate by means of said securement means, the opposite ends of said rod means being secured to the respective ones of said anchor means.

3. The railroad crossing structure of claim 1, further comprising a cylindrical channel on each of the opposite side edges of said flexible plate along at least a portion of the longitudinal length thereof, said tie down means further comprising a pair of rod means extending longitudinally through said cylindrical channels and having the opposite ends thereof secured to the respective ones of said anchor means.

4. The railroad crossing structure of claim 3, wherein said anchor means comprise a metal plate fixedly secured to each of the two ties disposed adjacent the opposite longitudinal ends of said elstomeric pad, the ends of said pair of rod means being extended through apertures formed in said metal plates and secured therein.

5. A railroad crossing structure for use with a highway railroad crossing having a pair of spaced, substantially parallel rails, a plurality of elongated ties subtending and supporting said rails and being disposed transversely thereof, and means for securing said rails to said ties, said railroad crossing structure comprising:

(a) a pair of elongated elastomeric pads of a width proportioned to span the distance between said pair of spaced, substantially parallel rails, each of said pads having along at least one edge thereof a channel for receiving therein the flange portion of a wheel of a railroad car and for providing a drainage channel for water and the like;

(b) a flexible plate of a generally concave cross-section imbedded within each of said elastomeric pads and having a cylindrical channel on each of the opposite sides thereof along at least a portion of the longitudinal length thereof, said flexible plates having a deflecting action as vehicles drive over said railroad crossing structure which functions as a shock absorber to provide a vehicle smoother transition over said railroad crossing structure and to force the edge of said flexible plate towards said channel to break up foreign objects such as snow, ice and the like which may form or collect in said channel; and (c) tie down means for securing said elastomeric pads atop said plurality of ties, said tie down means comprising anchor means, and rod means extending longitudinally through each of said cylindrical channels, the opposite ends of said rod means being secured to the respective ones of said anchor means.

6. The railroad crossing structure of claim 5, wherein said anchor means comprise a metal plate fixedly secured to each of the two ties which are disposed adjacent the opposite longitudinal ends of said pads, the ends of said rod means being extended through apertures formed in said metal plates and secured therein.

7. The railroad crossing structure of claim 6, wherein the abutting edges of said pair of elastomeric pads are provided with complimentary interlocking means for releasably securing the abutting edges thereof together and for sealing the abutting edges so as to prevent water and the like from passing between and through the abutting edges.

8. The railroad crossing structure of claim 7, wherein the opposite edges of said pair of elastomeric pads which are adjacent the respective ones of said rails tightly abut against said rails and are formed with a generally V-shaped channel for receiving therein the flange portion of a wheel of a railroad car and for providing a drainage channel for water and the like.

9. The railroad crossing structure of claim 5, further comprising a plurality of said elastomeric pads disposed between said rails in end to end relationship, said rod means extending longitudinally through said pads in end to end relationship to secure said pads in place.

10. The railroad crossing structure of claim 9, wherein the abutting edges of said elastomeric pads all are correspondingly formed with complimentary interlocking means, whereby the edges of said pads abutted and secured together are sealed so as to be substantially moisture-proof.

11. The railroad crossing structure of claim 5, further comprising an elastomeric side edge pad disposed between the respective ones of said rails and the adjacent edges of the highway, said side edge pads being proportioned to fit tightly between said rails and the adjacent edge of the highway, said elastomeric side edge pads each having a flexible plate of a generally concave cross-section imbedded within it, said flexible plates having a cylindrical channel on each of the opposite sides thereof along at least a portion of the longitudinal length thereon, and tie down means for securing said elastomeric side edge pad atop said plurality of ties comprising plate means fixedly secured to the two ties which are disposed adjacent the opposite longitudinal ends of said elastomeric side edge pads, and rod means extending longitudinally through each of said cylindrical channels, the opposite ends of said rod means being secured to the respective ones of said plate means.

12. The railroad crossing structure of claim 11, wherein said plate means comprising said anchor means extend to overlap the corner edges of the highway along the sides thereof and are secured to the side of the highway, whereby cornering of the crossing and the highway is prevented.

* * * * *